US006641437B2

(12) United States Patent
Tsuji et al.

(10) Patent No.: US 6,641,437 B2
(45) Date of Patent: Nov. 4, 2003

(54) CONNECTOR

(75) Inventors: Takeshi Tsuji, Yokkaichi (JP); Masaaki Tabata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/303,346

(22) Filed: Nov. 22, 2002

(65) Prior Publication Data

US 2003/0100230 A1 May 29, 2003

(30) Foreign Application Priority Data

Nov. 29, 2001 (JP) ..... 2001-364098

(51) Int. Cl.[7] ..... H01R 13/422
(52) U.S. Cl. ..... 439/595
(58) Field of Search ..... 439/595, 752

(56) References Cited

U.S. PATENT DOCUMENTS 6,165,011 A * 12/2000 Fukuda ..... 439/595
6,244,900 B1 * 6/2001 Ishikawa et al. ..... 439/595
6,334,790 B2 * 1/2002 Kashiyama et al. ..... 439/595
6,338,654 B1 * 1/2002 Sasaki et al. ..... 439/595
6,375,502 B2 * 4/2002 Yoshida et al. ..... 439/595
6,390,849 B1 5/2002 Yamanashi et al.

* cited by examiner

*Primary Examiner*—Gary Paumen
*Assistant Examiner*—James R. Harvey
(74) *Attorney, Agent, or Firm*—Anthony J. Casella; Gerald E. Hespos

(57) ABSTRACT

A connector has a housing (20) with a main body (21) and a front-wall member (40). The main body (21) has cavities (25) and resiliently deflectable locks (30) are cantilevered forwardly in the cavity (25) for engagement with corresponding male terminal fittings (10). Sidewalls of the cavities (25) adjacent the locks 30 are formed by sidewall portions (45) and a partition wall (46) of the front wall member (40). As a result, each lock (30) has a width substantially equal to the entire width of the cavity (25) and large locking forces can be obtained.

19 Claims, 14 Drawing Sheets

CONNECTOR

BACKGROUND OF THE INVENTION

1. Field of the Invention

The invention relates to a connector with cavities with resin locks for locking terminal fittings inserted into the cavities.

2. Description of the Related Art

U.S. Pat. No. 6,390,849 discloses a connector that has a housing formed with cavities into which terminal fittings are insertable. Resilient deflectable locks are cantilevered adjacent the cavities and extend along the inserting direction of the terminal fittings. The terminal fittings are pushed into the cavities and deform the locks about their base ends. The locks are restored resiliently when the terminal fittings are inserted to proper positions. Thus, the leading ends of the locks engage the terminal fittings and prevent them from coming out.

The housing of the above-described connector is molded from a synthetic resin. The molding must be carried out so that clearances exist between the locks and the sidewalls of the cavities so that the locks can deform. The clearances are formed by molding pins that project from a base surface of the mold used to form an end surface of the housing. The molding pins are required to have a specified thickness to ensure sufficient strength and, the clearances corresponding to this thickness are invariably formed at the opposite sides of the locks. Thus, the width of each lock is restricted to a dimension obtained by subtracting the widths of the clearances at the opposite sides of the lock from the entire width of the cavity. Narrow locks may not exhibit sufficient locking force.

The present invention was developed in view of the above problem and an object thereof is to enhance a terminal locking force.

SUMMARY OF THE INVENTION

The invention is directed to a connector with a housing and at least one cavity formed in the housing. At least one terminal fitting is insertable into the cavity. At least one resiliently deflectable lock is cantilevered in the cavity and extends substantially along the inserting direction of the terminal fitting for locking the terminal fitting in the cavity. A separate front-wall member is mounted to the housing and has sidewall portions for forming sidewalls of the cavity at the opposite sides of the locks.

The lock is formed during molding and spaces are defined at the opposite sides of the lock. The front-wall member then is mounted so that the sidewall portions enter the spaces adjacent the lock. Accordingly, the lock can have a width substantially equal to the entire width of the cavity.

Thus, the lock is engageable with, for example, corners at the opposite sides of an engaging portion of the terminal fitting, thereby enhancing a terminal locking force thereof.

The lock can be thinned while maintaining a specified terminal locking force, and the deformation space can be made smaller as much as the lock is thinned. As a result, the connector advantageously can be miniaturized.

The front-wall member may comprise a retainer that projects into a deformation space for the lock. Thus, the terminal fitting is inserted into the cavity and is engaged by the lock. The front wall member then is mounted so that the retainer projects into the deformation space and prevents deformation of the lock. Accordingly, the terminal fitting is locked doubly.

The front-wall member preferably can be held at a partial locking position where the retainer is retracted forward from the deformation space to permit the resilient deformation of the lock and at a full locking position where the retainer projects into the deformation space.

The terminal fitting is inserted into the cavity with the front-wall member at the partial locking position. The front-wall member then is pushed to the full locking position so that the retainer prevents deformation of the lock and redundantly locks the terminal fitting. The connector is convenient to handle since the front-wall member can be partly assembled with the housing.

A disengagement projection may be formed in the widthwise center of the surface of the lock that faces the deformation space. The retainer may comprise elongated restricting projections that can contact the disengagement projection of the lock. Additionally, an introducing groove may be defined between the elongated restricting projections for receiving a disengagement jig that is engageable with the disengagement projection.

The elongated restricting projections of the retainer contact opposite sides of the lock to prevent deformation of the lock when the front-wall member is at the full locking position. Thus, the terminal fitting is locked redundantly. However, the front-wall member can be returned to the partial locking position. The disengagement jig then can be inserted through the introducing groove between the restricting projections to catch the disengagement projection and deform the lock. The terminal fitting then is freed from its locked state.

The lock preferably is in the deformation space if the terminal fitting is inserted only partly. Thus, the retainer cannot enter the deformation space and the front-wall member cannot be displaced to the full locking position when the terminal fitting is inserted only partly.

A pair of ribs may be formed at the surface of the lock facing the cavity and are spaced apart to permit insertion of the terminal fitting. Thus, the locking can be reinforced while the insertion and withdrawal of the terminal fitting are permitted.

The lock may extend over substantially the entire width of the cavity.

The terminal fitting preferably has an engagement portion for contacting the lock. The engagement portion extends over substantially the entire width of the terminal fitting. Most preferably, the locking engages lateral corners of the engagement portion of the terminal fitting.

These and other features and advantages of the invention will become more apparent upon reading of the following detailed description and the drawings. Even though embodiments are described separately, single features may be combined to additional embodiments.

DETAILED DESCRIPTION OF THE PREFERRED EMBODIMENTS

Figure 1:
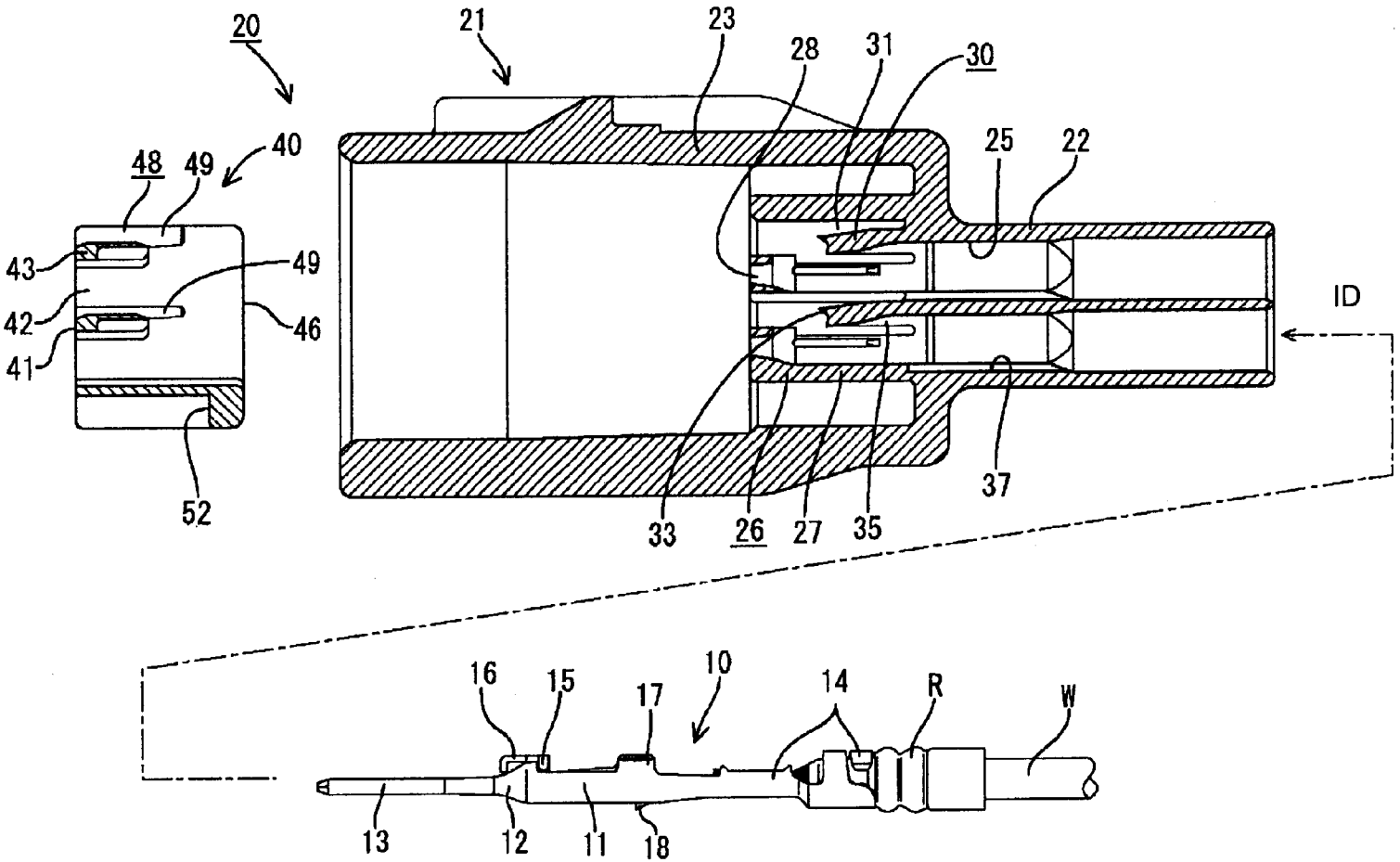
FIG. 1 is an exploded longitudinal section of a connector according to one embodiment of the invention.
Figure 2:
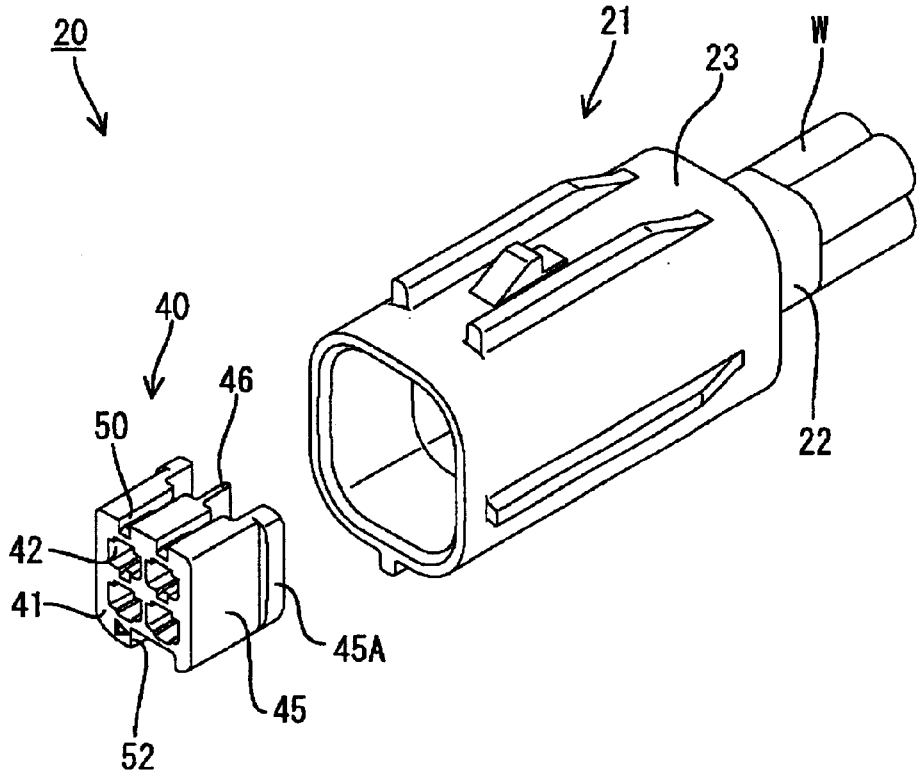
FIG. 2 is an exploded perspective view of a housing.

A male watertight connector according to the invention includes a housing 20 and male terminal fittings 10 to be accommodated in the housing 20, as shown in FIGS. 1 and 2. The housing 20 includes a main body 21 and a front-wall member 40.

Each terminal fitting 10 is press-formed of a metal plate that has good electrical conductivity. As shown in FIG. 1, the terminal fitting 10 includes a rectangular tubular main body 11 with a tapered front end 12 and a tab 13 projects from the tapered front end 12. Barrels 14 are formed at the rear end of the terminal fitting 10, and are configured to be crimped, bent or folded into connection with an end of a wire W and with a waterproof rubber plug R. A substantially gate-shaped engaging portion 15 projects over substantially the entire width of the terminal fitting 10 at a position on the upper surface of the main body 11 near the front end (see FIG. 4). A contact portion 16 is formed at the front edge of the engaging portion 15 and extends up into proximity with the front end of the inclined portion 12. The contact portion 16 is narrowed gradually and then bends down toward the main body 11.

Stabilizers 17 project from opposite edges at the rear of the upper surface of the main portion 11, and a projection 18 is formed near the rear of the bottom surface of the main portion 11 for preventing inverted insertion.

Figure 10:
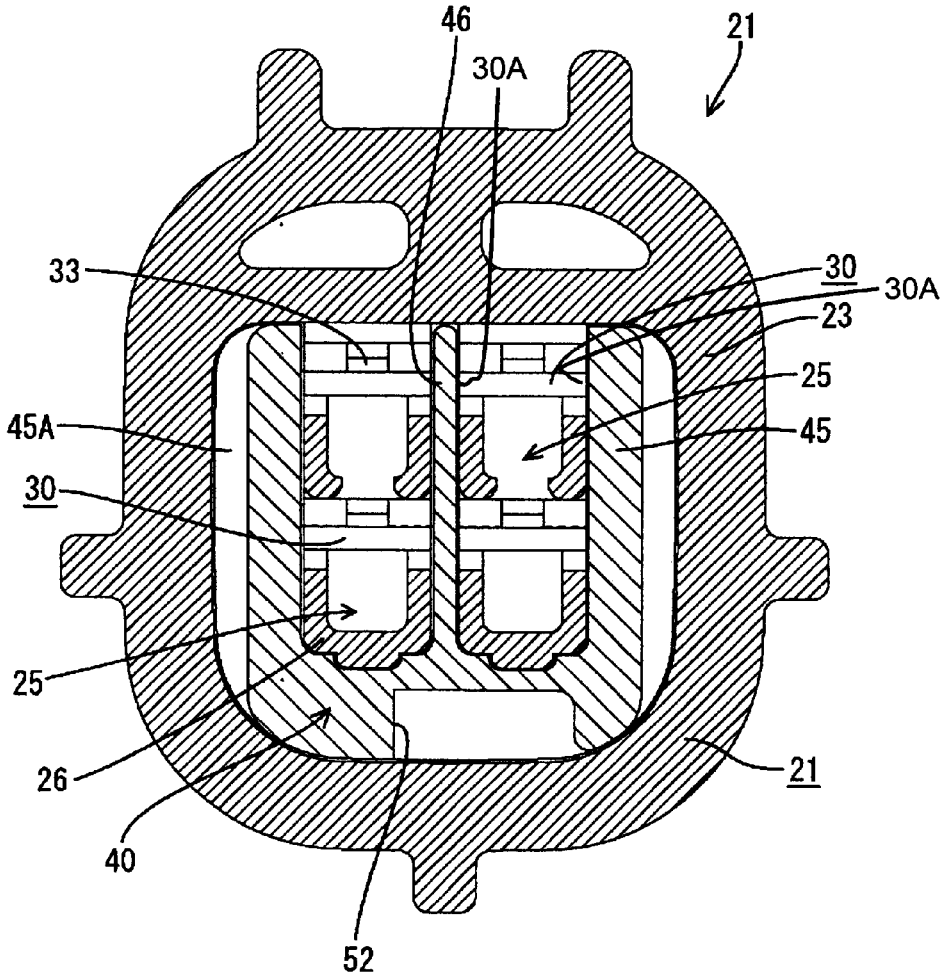
FIG. 10 is a lateral section showing the state of FIG. 9.

The housing main body 21 is made e.g. of a synthetic resin and has a tower 22 and a receptacle 23. The receptacle 23 projects forward from the tower 22 and substantially covers a front part of the tower 22. Cavities 25 extend in forward and backward directions in a lattice-like arrangement in the tower 22, as shown in FIG. 10, and the male terminal fittings 10 are insertable into the cavities 25 in an inserting direction ID. The front part of the tower portion 22 projects into the receptacle 23 and is divided into terminal accommodating portions 26 that correspond to the positions of the cavities 25.

A grooved accommodating wall 27 is formed in each terminal accommodating portion 26 and defines the lower portions of the opposite side surfaces of the corresponding cavity 25. At least part of the main portion 11 of the male terminal fitting 10 can be accommodated closely in the accommodating wall 27 along the widthwise direction (see FIG. 13). A terminal insertion opening 28 is formed in the front of the accommodating wall 27 and the tab 13 of the male terminal fitting 10 projects through the terminal insertion opening 28 and into the receptacle 23.

An escape groove 27A is formed substantially in the widthwise center of the bottom of the accommodating wall 27 in both terminal accommodating portions 26 at the upper stage to define deformation spaces 31.

Figure 3:
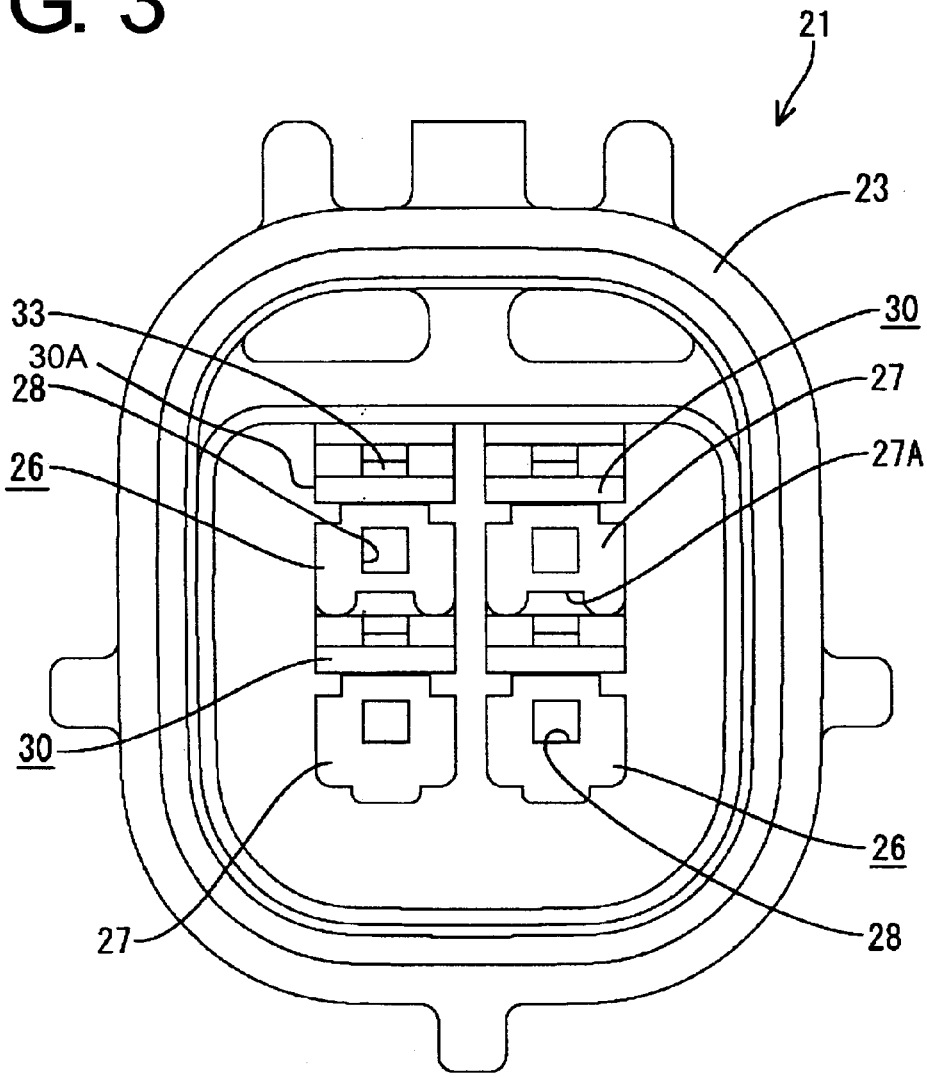
FIG. 3 is a front view of a housing main body.
Figure 4:
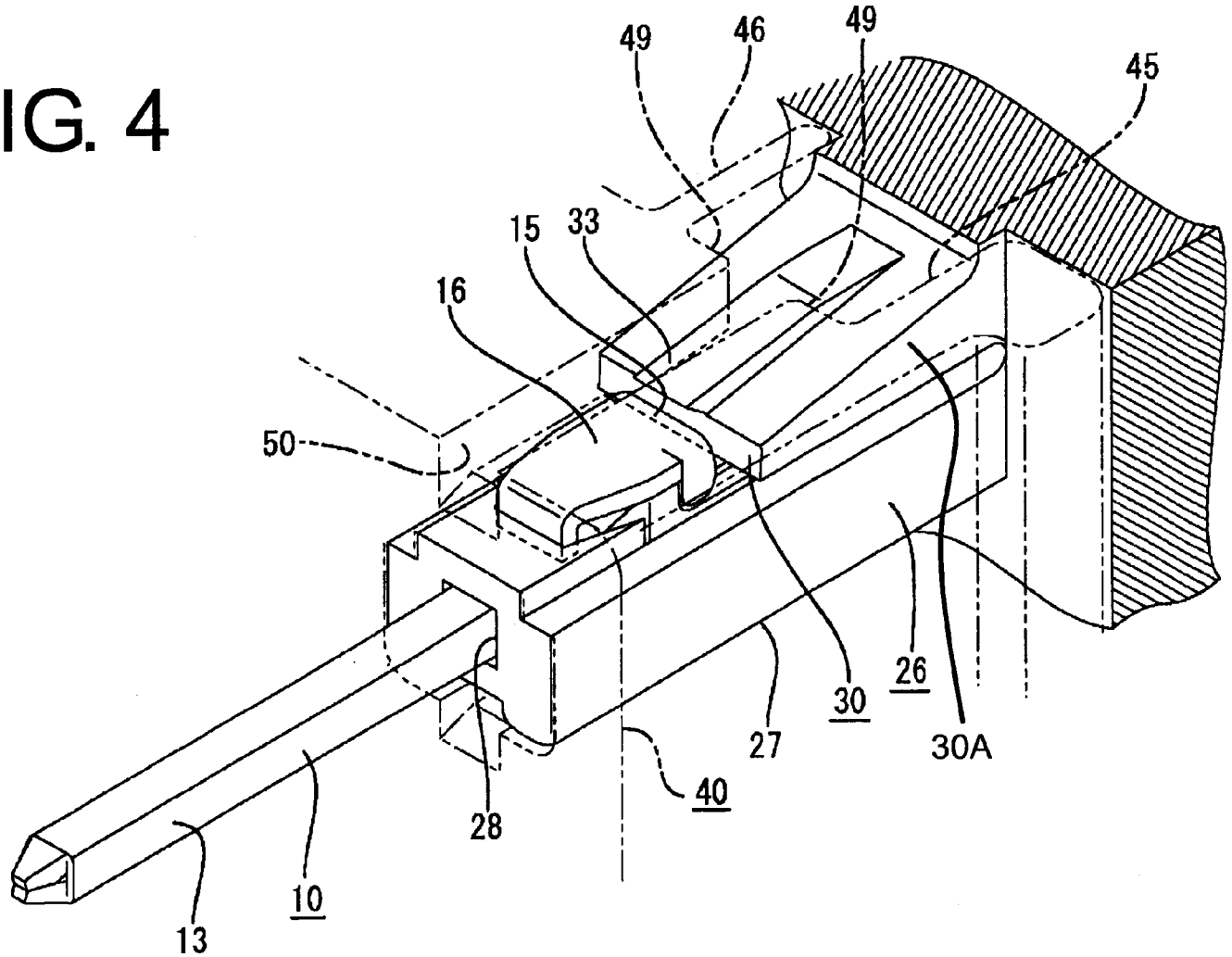
FIG. 4 is a perspective view of a terminal accommodating portion.
Figure 13:
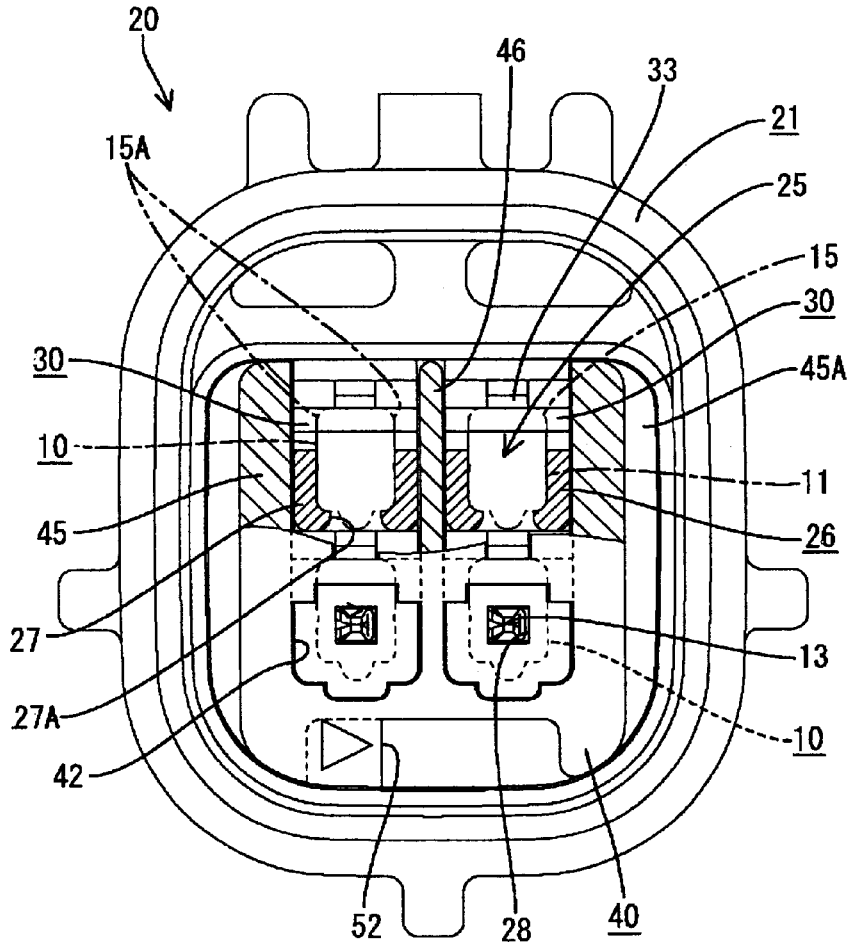
FIG. 13 is a front view partly in section showing a state where male terminal fitting are partly locked.

A resiliently deflectable lock 30 is cantilevered at the ceiling of each cavity 25 and is engageable with the male terminal fitting 10. Each lock 30 is wider than the accommodating wall 27, as shown in FIG. 3, and also is wider than the engaging portion 15 of the male terminal fitting 10, as shown in FIG. 13. Each lock 30 projects forward and is inclined slightly down from the proximity of the base end of the terminal accommodating portion 26. Additionally, each lock 30 can deform into a deformation space 31 located above as shown in FIG. 1. The leading end surface of the lock 30 can engage the engaging portion 15 of the male terminal fitting 10 over substantially the entire width of the engaging portion 15 as shown in FIGS. 4 and 13.

Figure 5:
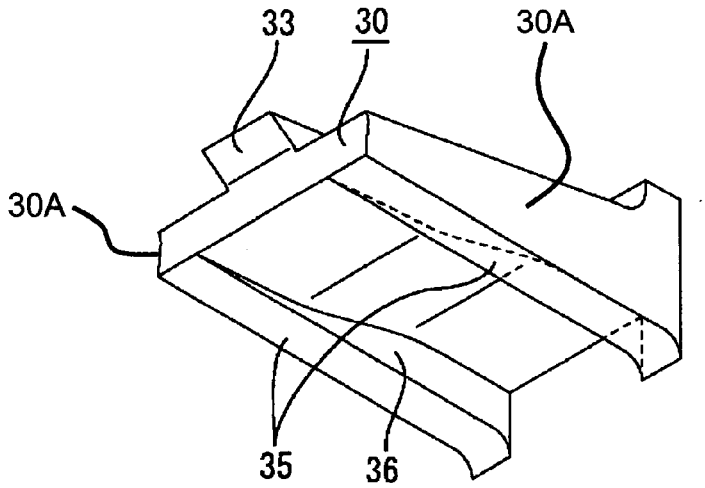
FIG. 5 is a perspective view of a locking portion.

An elongated disengagement projection 33 is formed on the upper surface of the lock 30 and extends from the leading end to a position near the rear end of the lock 30 substantially along the longitudinal extension of the lock 30. The leading end surface of the elongated disengagement projection 33 projects from the leading end of the lock 30 in an overhanging forwardly slanted manner, as shown in FIG. 5. Thus, the distal end of the disengaging projection 33 projects more than the distal end of the lock 30. The leading end surface of the elongated disengagement projection 33 can be caught by a disengagement jig J (see FIG. 16) and the lock 30 can be deformed by the jig J to disengage the lock 30 from the engaging portion 15 of the male terminal fitting 10.

Two reinforcing ribs 35 are formed along substantially opposite side edges or edge portions of the lower surface of each lock 30 and face substantially towards the respective cavity 25. The reinforcing ribs 35 have heights that gradually increase toward their rear ends, and the bottom ends thereof are substantially horizontal and parallel to the inserting/withdrawing direction of the terminal fitting 10 in a natural state where no force acts on the lock 30. A clearance 36 through which the main portion 11 of the male terminal fitting 10 is insertable is defined between the two reinforcing ribs 35.

A slide groove 37 along which the projection 18 of the male terminal fitting 10 is slidable is formed in a longitudinal middle of the bottom wall of each cavity 25 and extends substantially in forward and backward directions.

Figure 6:
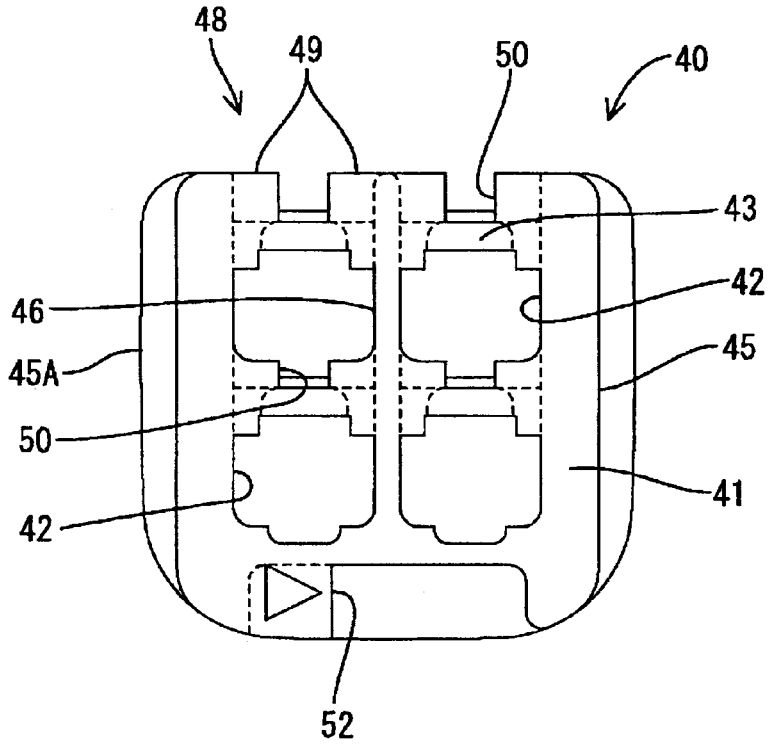
FIG. 6 is a front view of a front-wall member.
Figure 7:
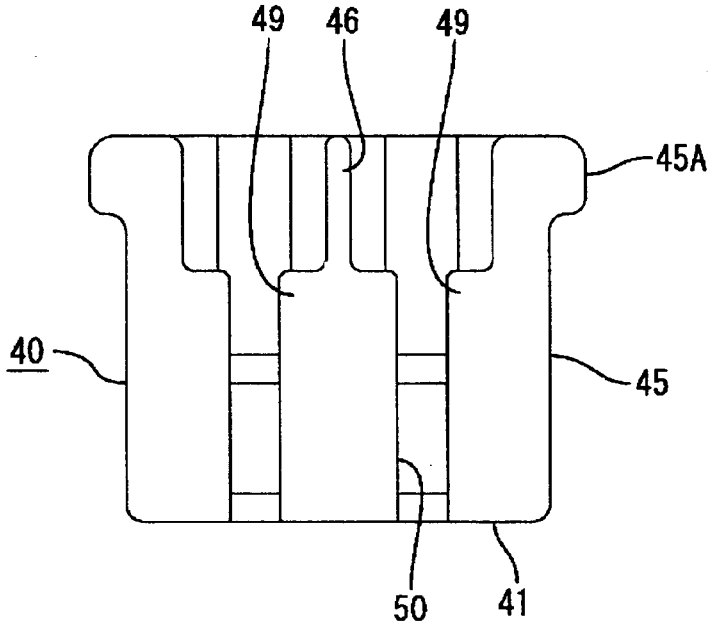
FIG. 7 is a plan view of the front-wall member.
Figure 8:
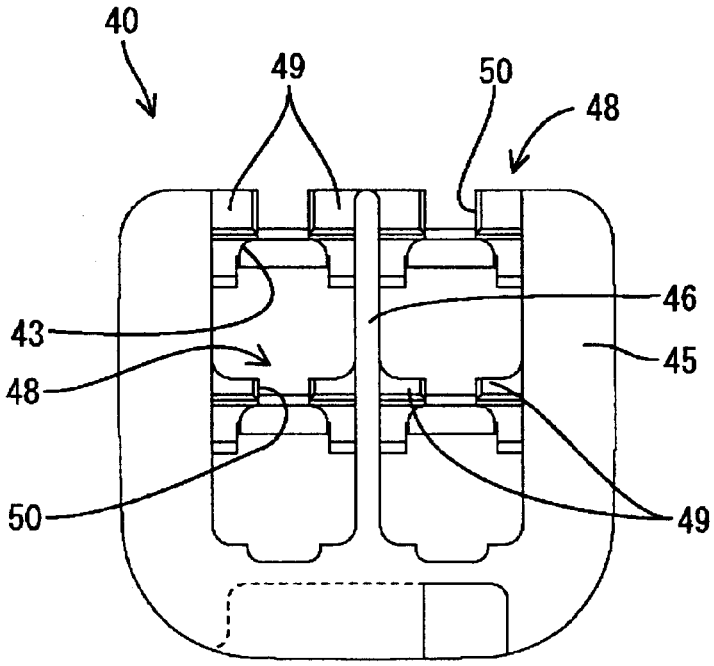
FIG. 8 is a rear view of the front-wall member.

The front-wall member 40 is made e.g. of a synthetic resin, and substantially defines a cap fittable to the front of the tower 22 of the main body 21. The front-wall member 40 has a front wall 41 with windows 42, as shown in FIGS. 6 to 8, into which at least part of the leading ends of the terminal accommodating portions 26 divided in the tower 22 are fittable, and accommodating portions 43 are formed above the windows 42 for receiving the contacts 16 of the male terminal fittings 10.

A substantially U-shaped thick sidewall 45 extends rearwardly from the front wall 41 and continues from the opposite side edges to the bottom edge. A thin partition-wall portion 46 is formed substantially along the widthwise center. A bulge 45A is formed on the outer surface of the rear end of the sidewall 45. When the front-wall member 40 is mounted on the front end of the tower 22, the U-shaped sidewall 45, including the bulge 45A is inserted in close contact with the inner circumferential surface of the receptacle 23 at a corner portion between the left side surface and the bottom surface and a corner portion between the right side surface and the bottom surface, and the partition-wall 46 is inserted closely between the left and right terminal accommodating portions 26 at two upper and lower stages, as shown in FIG. 10.

Accordingly, the sidewall 45 and the partition wall 46 form at least upper parts of the sidewalls of the cavities 25 in the respective terminal accommodating portions 26. More particularly, the left and right side surfaces 30A of the locks 30 of the respective cavities 25 are adjacent the sidewall 45 and the partition wall portion 46. Thus, the sidewall 45 and the partition wall portion 46 of the front-wall member 40 define part of the cavity 25 where the terminal fitting 10 is accommodated when the front wall member 40 is mounted to the tower 22 so that the sides 30A of the lock 30 are close to the front wall member 40. Accordingly, the lock 30 may be formed with the front-wall member removed or not positioned at the tower 22 thus allowing the lock 30 to have a larger width and improved operability.

A retainer 48 for doubly locking the terminal fitting 10 is provided on the upper surface of each of four accommodating portions 43 formed in the front-wall member 40. The retainer 48 is formed by left and right elongated restricting projections 49 fittable at the opposite sides of the elongated disengagement projection 33 of the lock 30. The elongated restricting projections 49 project more backward than the rear end of the accommodating portion 43. A jig-introducing groove 50 through is defined between the two restricting projections 49 for receiving the disengagement jig J.

Figure 9:
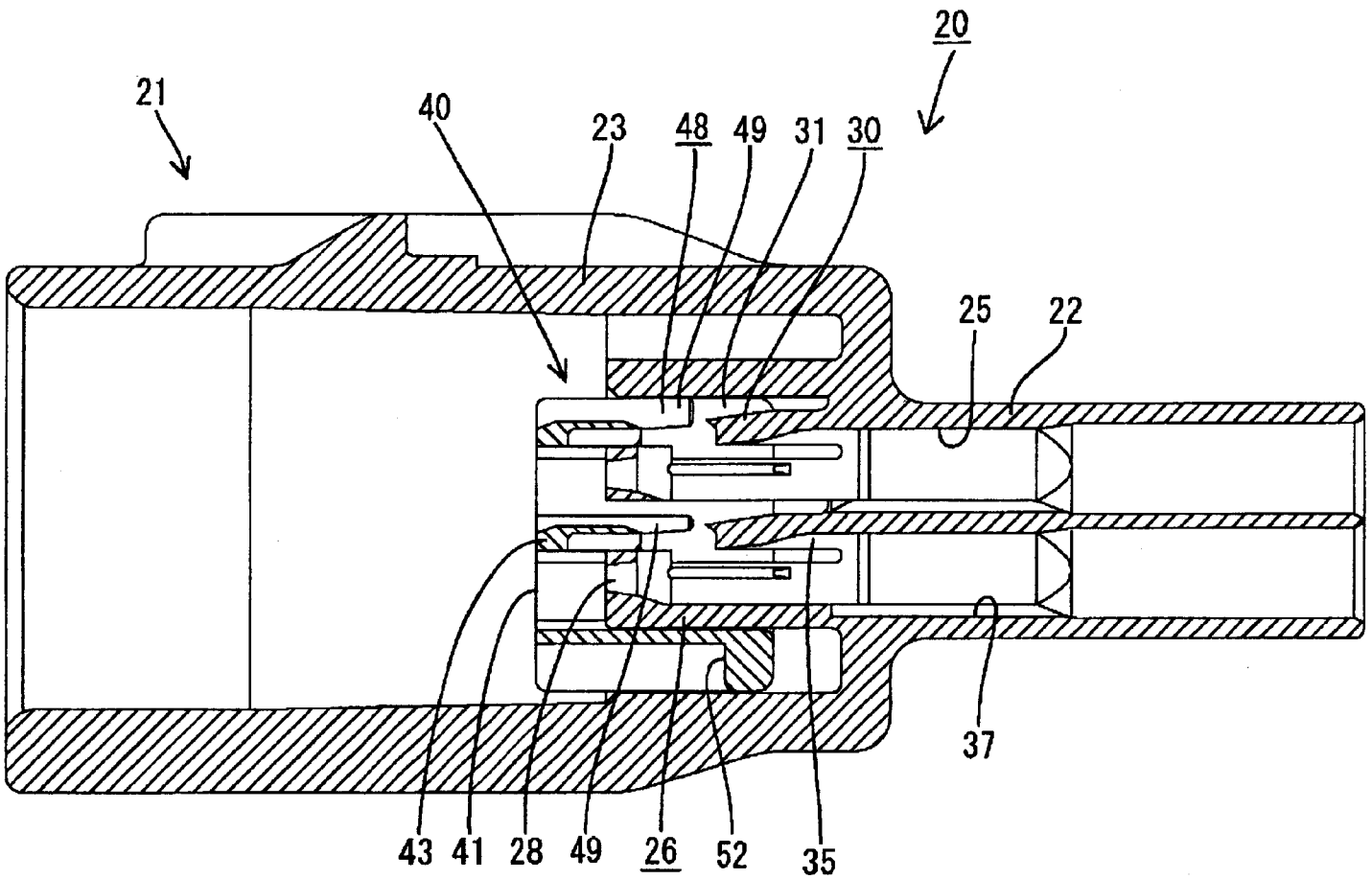
FIG. 9 is a longitudinal section showing a state where the front-wall member is mounted at a partial locking or first position.
Figure 14:
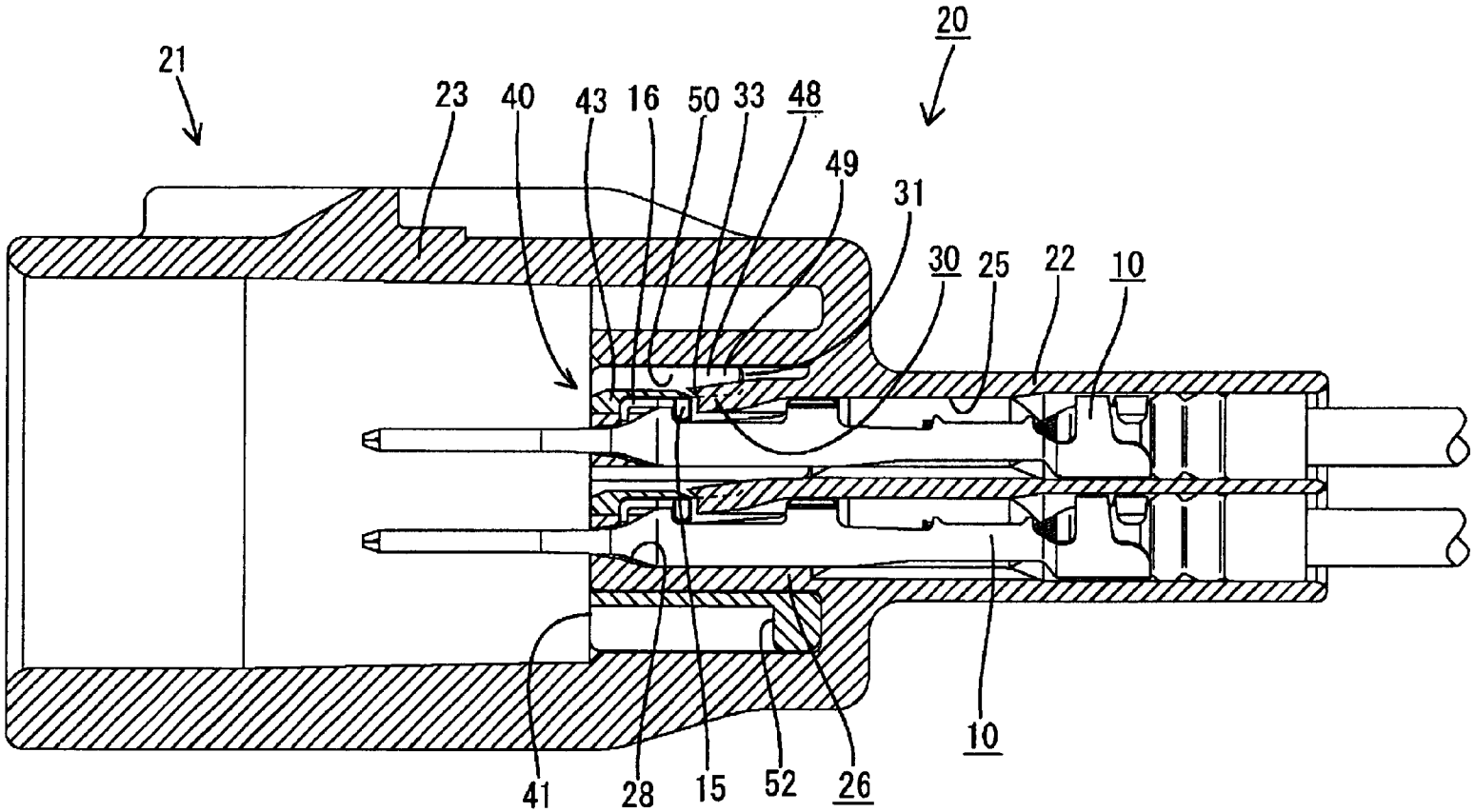
FIG. 14 is a longitudinal section showing a state where the front-wall member is mounted at a full locking or second position.

The front-wall member 40 can be held on the leading end of the tower portion 22 at a partial locking position shown in FIG. 9 and at a full locking position shown in FIG. 14. Constructions for holding the front-wall member 40 at these two positions may be provided even though not described here in detail.

The retainers 48, are located before the deformation spaces 31 for the locks 30 when the front wall member 40 is at the partial locking position to permit deformation of the locks 30. On the other hand, the front wall 41 is substantially flush with the front surface of the tower 22 and the retainers 48 are in the deformation spaces 31 when the front wall member 40 is at the full locking position to fit the elongated restricting projections 49 at the opposite sides of the elongated disengagement projections 33 of the locks 30.

A jig insertion groove 52 is formed at the bottom of the front-wall member 40. The jig insertion groove 52 is open in the front surface of the front-wall member 40 and is bent into a hooked shape at the backside. This groove 52 enables insertion of a jig (not shown) to return the front-wall member 40 from the full locking position to the partial locking position.

The front-wall member 40 initially is mounted at the partial locking position on the leading end of the tower 22, as shown in FIG. 9. At the partial locking position, the retainers 48 are retracted forward from the deformation spaces 31 for the locks 30 to permit the resilient deformation of the locks 30 toward the deformation spaces 31. Further, as shown in FIG. 10, the sidewall 45 and the partition wall portion 46 of the front-wall member 40 form parts of the sidewalls of the cavities 25, and the locks 30 are held between the sidewall 45 and the partition wall 46.

Figure 11:
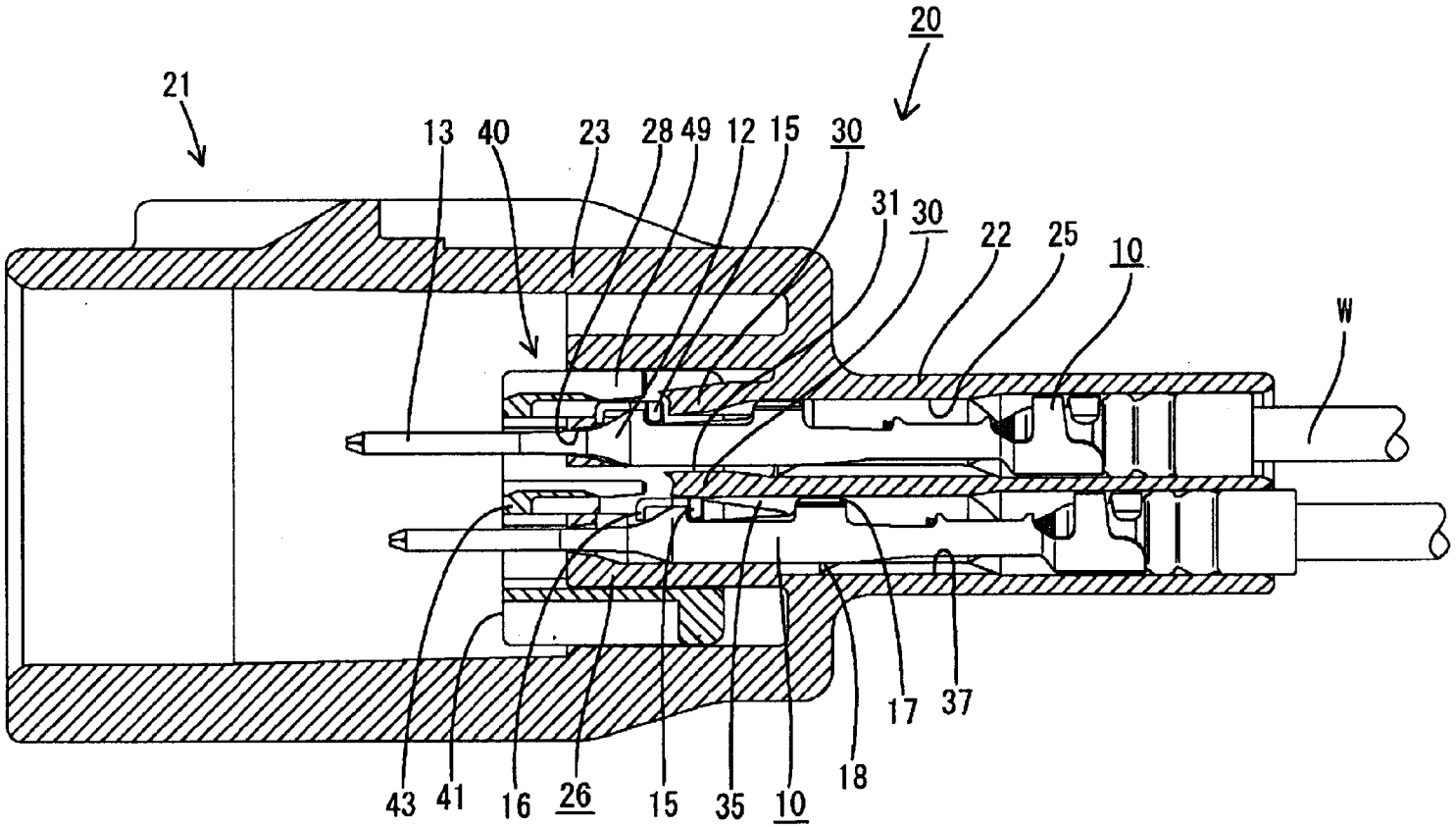
FIG. 11 is a longitudinal section showing insertion of male terminal fittings.
Figure 12:
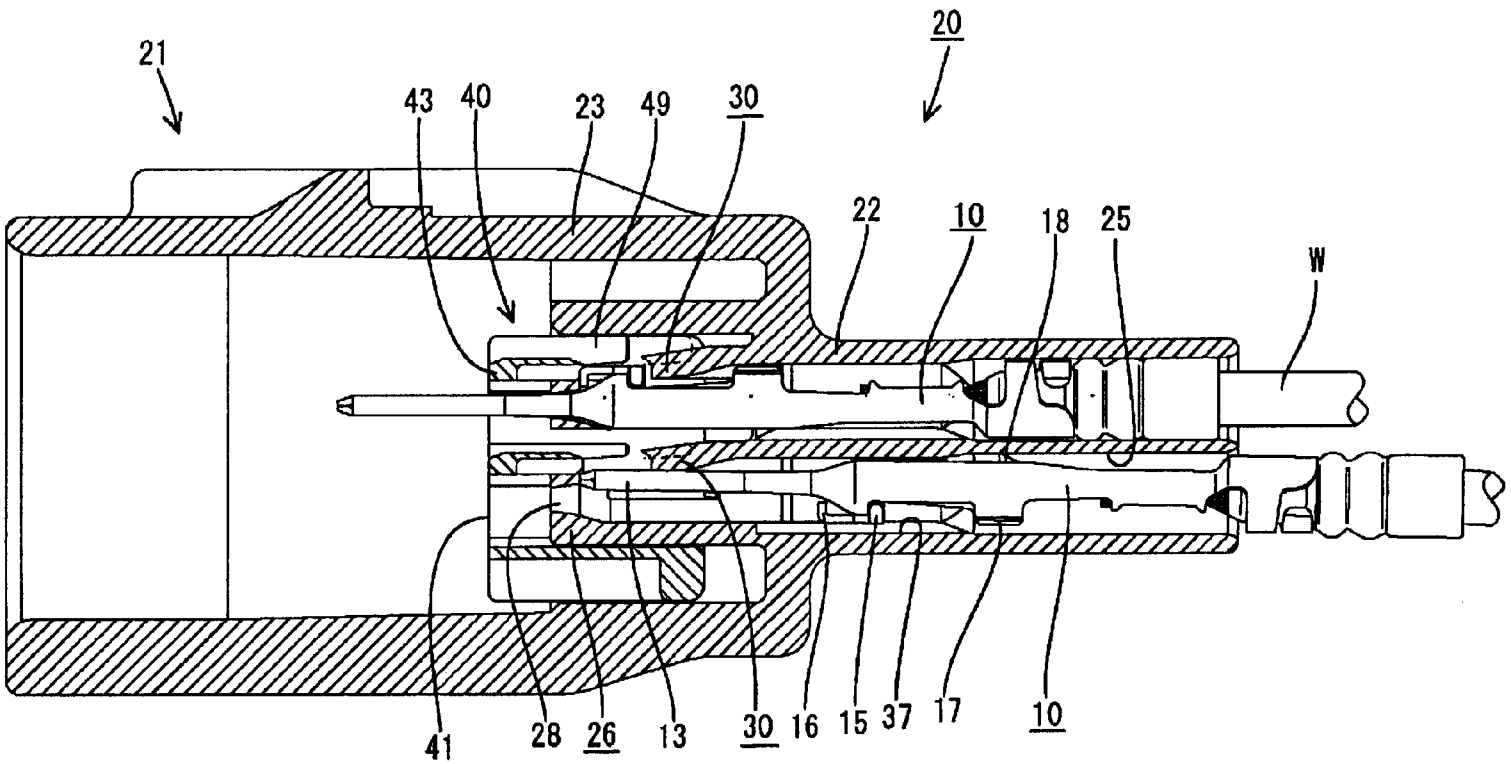
FIG. 12 is a longitudinal section showing a state where the upside-down insertion of the male terminal fitting is detected.

In this state, the male terminal fitting 10 is inserted into the corresponding cavity 25 in the inserting direction ID from a side opposite to the front wall member 40, as shown by an arrow in FIG. 1. The male terminal fitting 10 is pushed so that the stabilizers 17 slide along the ceiling wall of the cavity 25 and the projection 18 slides along the slide groove 37. A portion of the male terminal fitting 10 from the contact 16 to the engaging portion 15 moves between the reinforcing ribs 35 on the lower surface of the lock 30 at an intermediate stage, and the male terminal fitting 10, deforms the lock 30 into the deformation space 31, as shown at the lower stage in FIG. 11.

If the male terminal fitting 10 erroneously is inverted, the projection 18 contacts the ceiling surface of the cavity 25 and the male terminal fitting 10 cannot be pushed any further. This enables the erroneous upside-down or improper insertion of the male terminal fitting 10 to be detected and avoided.

The male terminal fitting 10 can be pushed in the inserting direction ID to a proper position. In this position, the tab 13 projects through the terminal insertion opening 28 and the inclined portion 12 contacts the rear edge of the terminal insertion opening 28, as shown at the upper stage in FIG. 11. Additionally, the engaging portion 15 passes the leading end of the lock 30. Thus, the lock 30 is restored resiliently to bring the leading end surface of the lock 30 into engagement with the engaging portion 15 for partial locking.

The lock 30 has a width substantially equal to the entire width of the cavity 25. Thus, the leading end surface of the lock 30 is engaged with the entire width of the engaging portion 15. More particularly, a large locking force can be obtained by engaging the leading end surface of the lock 30 with left and right or lateral corners 15A of the engaging portion 15.

The front-wall member 40 is pushed to the full locking position shown in FIG. 14 after all the male terminal fittings 10 have been inserted. Then, the front wall 41 becomes substantially flush with the front surface of the tower 22 and the contacts 16 of the male terminal fittings 10 are accommodated into the accommodating portions 43.

Simultaneously, the elongated restricting projections 49 of the retainer portions 48 move to opposite sides of the elongated disengagement projections 33 of the locks 30 and enter the deformation spaces 31. As a result, the male terminal fittings 10 are locked redundantly by preventing the locks 30 from deflecting into the deformation permitting spaces 31.

Figure 15:
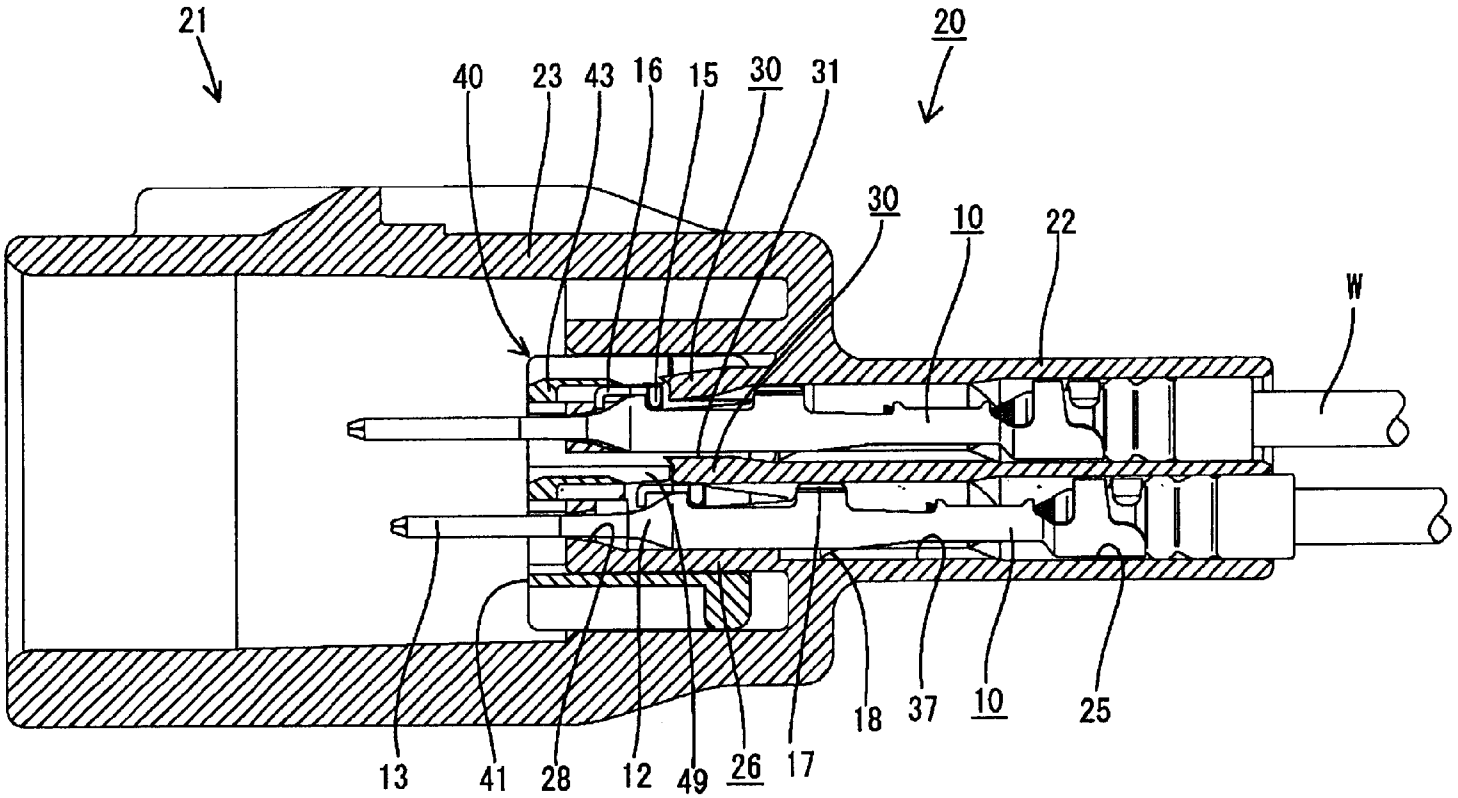
FIG. 15 is a longitudinal section showing a state where the insufficient insertion of the male terminal fitting is detected.

The male terminal fitting 10 may be left insufficiently inserted into the cavity 25, as shown at the lower stage of FIG. 15. In such a case, the lock 30 still is in the deformation space 31. Accordingly, the leading ends of the elongated restricting projections 49 contact the leading end of the lock 30, and the front member 40 cannot be pushed to the full locking position. This enables the insufficiently inserted state of the male terminal fitting 10 to be detected. The front-wall member 40 may be pushed to the full locking position again after the male terminal fitting 10 is pushed to the proper position.

The male terminal fitting 10 can be withdrawn from the housing 20 for maintenance or other reason. In particular, a jig with a hooked leading end is inserted into the jig insertion groove 52 of the front-wall member 40 while the front wall member 40 is at the full locking position shown in FIG. 14. The jig catches the bent back end and the front-wall member 40 is returned to the partial locking position by pulling the jig forward. In this way, the retainers 48 are retracted forward from the deformation spaces 31. On the other hand, the elongated disengagement projections 33 of the locks 30 are exposed forward through the jig introducing grooves 50 between the elongated restricting projections 49 forming the retainers 48.

Figure 16:
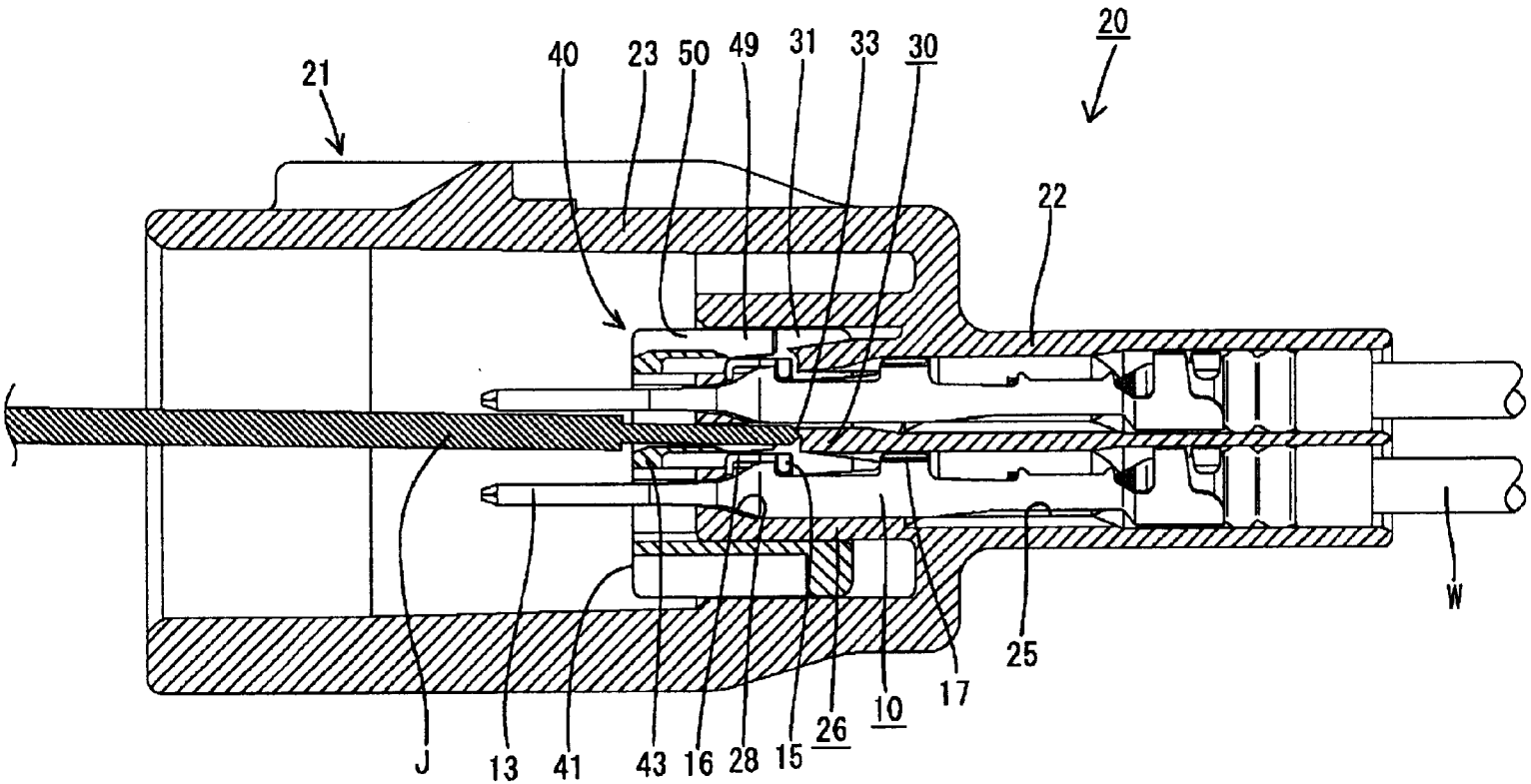
FIG. 16 is a longitudinal section showing an operation of disengaging the locking portion to cancel partial locking.

Accordingly, as shown in the lower stage of FIG. 16, the disengagement jig J can be introduced into the jig-introducing groove 52 of the front-wall member 40 to catch the elongated disengagement projection 33 of the lock 30, and then operated to deform the lock 30 toward the deformation space 31 and away from the terminal fitting 10. In this way, the lock 30 is disengaged from the engaging portion 15, and the male terminal fitting 10 can be withdrawn backward from the cavity 25 by pulling the wire W.

As described above, the separate front-wall member 40 forms portions of the sidewalls of the cavities 25 that have the locks 30. Thus, the locks 30 can have a width substantially equal to the entire width of the cavities 25. Therefore, the locks 30 can engage the engaging portions 15 over substantially the entire width of the engaging portions 15 and large locking forces can be obtained by engaging the left and right corners 15A of the engaging portions 15. Further, lateral shaking of the locks 30 is prevented, contributing to the enhanced locking forces. By enhancing the locking forces in this way, the locks 30 can be made thinner along a deformation direction, and the deformation spaces 31 can be smaller. As a result, the housing 20 can be miniaturized.

The connector provides retainer function for preventing the resilient deformation of the locks 30 and the function of forcibly resiliently deforming the locks 30 to cancel partial locking. In particular, the elongated disengagement projections 33 are formed in the widthwise centers of the surfaces of the locks 30 that face the corresponding deformation spaces 31. Additionally, the elongated restricting projections 49 at opposite sides of the corresponding elongated disengagement projections 33 are provided as the retainers 48 and the jig introducing grooves 50 through which the disengagement jig J is insertable to catch the elongated disengagement projection 33 are defined between the elongated restricting projections 49 in the front-wall member 40. Thus, the above two functions can be realized by a compact construction.

The locks 30 can be reinforced while the insertion and withdrawal of the male terminal fittings 10 are permitted only by providing the reinforcing ribs 35 at the opposite sides of the surfaces of the locks 30 facing the cavities 25.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The present invention is also applicable to female connectors at least partly accommodating one or more female terminal fittings.

The present invention is also applicable to non-watertight connectors.

What is claimed is:

1. A connector with a housing having at least one cavity, the cavity having a ceiling wall and opposed sidewalls extending from the ceiling wall, at least one terminal fitting insertable into the cavity along an inserting direction, at least one resiliently deformable look cantilevered from the ceiling wall of the cavity and extending substantially along the inserting direction of the terminal fitting, the lock having opposite sides extending substantially along the inserting direction, and the housing being free of said side walls at locations adjacent the sides of the lock, the lock being configured for engagement with the terminal fitting, a separately formed front-wall member being separately mountable to a portion of the housing and comprising sidewall portions at the opposite sides of the lock for forming extensions of the sidewalls of the cavity.

2. The connector of claim 1, wherein the front-wall member is separately mountable at a portion of the connector housing for forming at least part of the front wall of the cavity.

3. The connector of claim 2, wherein the front-wall member comprises a retainer for preventing the resilient deformation of the lock by projecting into a deformation space for the lock.

4. The connector of claim 3, wherein the front-wall member can be held at a first position where the retainer is substantially retracted forward from the deformation space to permit the resilient deformation of the lock and at a second position where the retainer at least partly projects into the deformation space.

5. The connector of claim 4, wherein the retainer is configured to engage the lock in the deformation space to prevent the front-wall member from moving to the second position when the terminal fitting is in a partly inserted position.

6. The connector of claim 1, wherein a disengagement projection is formed in a substantially widthwise center of the locking on a side thereof facing the deformation space.

7. The connector of claim 6, wherein the retainer comprises a pair of elongated restricting projections that can contact the opposite side ends of the disengagement projection of the lock.

8. The connector of claim 7, wherein an introducing groove is defined between the elongated restricting projections for receiving a disengagement jig engageable with the projection.

9. The connector of claim 1, wherein two ribs are formed on the lock and substantially facing the cavity.

10. The connector of claim 9, wherein the ribs are formed at opposite sides of the lock and are spaced apart to permit insertion of the terminal fitting.

11. The connector of claim 1, wherein the cavity has a width, the lock extending over substantially the entire width of the cavity.

12. The connector of claim 1, wherein the terminal fitting has an engagement portion for contacting the lock, the engagement portion extending over substantially an entire width of the terminal fitting.

13. The connector of claim 1, wherein the lock is engaged with lateral corners of an engagement portion of the terminal fitting.

14. A connector with a housing having opposite front and rear ends and at least two cavities extending between the ends, each said cavity having a ceiling wall, a bottom wall and a pair of opposed sidewalls extending between the ceiling wall and the bottom wall for at least part of the cavity, said cavities being disposed such that each said cavity shares at least one sidewall with an adjacent one of said cavities, each said cavity having a resiliently deformable lock cantilevered toward the front end of the housing from the ceiling wall of the respective cavity, each said lock having opposite sides, the sidewalls being formed so as not to exist at locations adjacent the sides of the respective locks; and a front-wall member mounted to the front end of the housing and having a plurality of sidewall portions disposed respectively adjacent the sides of the locks for forming extensions of the sidewalls of each said cavity.

15. The connector of claim 14, wherein at least one sidewall portion of the front-wall member is disposed between locks of adjacent cavities.

16. The connector of claim 14, wherein the sidewalls of each said cavity are spaced from one another by a selected width, and wherein the sides of the lock for each said cavity are spaced from one another by a distance substantially equal to the width of the respective cavity.

17. The connector of claim 16, wherein the front-wall member comprises a retainer for preventing the resilient deformation of the lock by projecting into a deformation space for the lock.

18. The connector of claim 17, wherein the front-wall member is moveable between a first position where the retainer is retracted forward from the deformation space to permit the resilient deformation of the lock and at a second position where the retainer projects into the deformation space.

19. The connector of claim 18, wherein the retainer is configured to engage the lock in the deformation space to prevent the front-wall member from moving to the second position when the terminal fitting is in a partly inserted position.

* * * * *